US008613525B2

(12) United States Patent
Shimizu et al.

(10) Patent No.: US 8,613,525 B2
(45) Date of Patent: Dec. 24, 2013

(54) LED ILLUMINATION UNIT, LED ILLUMINATION DEVICE, AND LED ILLUMINATION SYSTEM

(75) Inventors: Hirotaka Shimizu, Kyoto (JP); Hironobu Kaneko, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 186 days.

(21) Appl. No.: 13/353,152

(22) Filed: Jan. 18, 2012

(65) Prior Publication Data

US 2012/0182734 A1 Jul. 19, 2012

(30) Foreign Application Priority Data

Jan. 18, 2011 (JP) ..... 2011-008065

(51) Int. Cl.
*F21V 29/00* (2006.01)

(52) U.S. Cl.
USPC ..... 362/218; 362/294; 362/373; 362/547; 362/249.02; 362/311.02

(58) Field of Classification Search
USPC ..... 362/217.01, 218, 219, 221, 222, 362/249.02, 311.02
See application file for complete search history.

(56) References Cited

U.S. PATENT DOCUMENTS

2005/0157500 A1* 7/2005 Chen et al. ..... 362/294
2010/0110679 A1* 5/2010 Teng et al. ..... 362/235

FOREIGN PATENT DOCUMENTS

JP 6-54103 7/1994

* cited by examiner

*Primary Examiner* — Ali Alavi
(74) *Attorney, Agent, or Firm* — Hamre, Schumann, Mueller & Larson, P.C.

(57) ABSTRACT

The present invention provides an LED (Light Emitting Diode) illumination unit, an LED illumination device, and an LED illumination system with better visual effect. The LED illumination unit includes: a substrate, having a carrying surface with an x direction as a length direction and a y direction as a width direction and facing a z direction; a plurality of LED chips, supported by the carrying surface of the substrate; a casing, allowing the light emitted from the LED chips to penetrate and covering the LED chips; and a heat dissipation component, having a pair of outside surfaces being planar, and mounted with the substrate and the casing, wherein the pair of outside surfaces is configured opposite and parallel to each other in the y direction at an interval, and is longer than the substrate in the x direction.

28 Claims, 17 Drawing Sheets

LED ILLUMINATION UNIT, LED ILLUMINATION DEVICE, AND LED ILLUMINATION SYSTEM

BACKGROUND OF THE INVENTION

1. Field of the Invention

The present invention relates to an LED (Light Emitting Diode) illumination unit, an LED illumination device, and an LED illumination system, including a plurality of LED chips and used for, for example, indoor ground illumination or wall surface illumination.

2. Description of the Related Art

FIG. 28 is a sectional view of an example of a conventional LED illumination device (for example, referring to Patent Document 1). An LED illumination device 90 shown in the figure includes a rectangular substrate 91, a plurality of LED chips 92 mounted on the substrate 91, a tube 93 accommodating the substrate 91, terminals 94, and a circuit 95 for turning the LED chips 92 on. A wiring, not shown in the drawings, connected to the LED chips 92 and the terminals 94 is formed on the substrate 91. The LED illumination device 90 is constructed such that the LED chips 92 can be enabled to emit light by plugging the terminals 94 into insert openings of a socket of general fluorescent lamp illumination equipment. As the LED chips 92 require low power consumption and have a long service life, improvements can be realized in aspects of cost and environment if the LED illumination device 90 is used to replace the fluorescent lamp. In addition, the fluorescent lamp illumination equipment for general use is illumination equipment mainly widely used for indoor general illumination, and for example, in Japan, refers to straight tubular fluorescent lamps specified in JIS (Japanese Industrial Standards) C7617 or annular fluorescent lamps specified in JIS C7618 using a 100 V power supply.

However, the conventional fluorescent lamp illumination equipment is constructed on the premise of presence of the terminals 94 at two ends and light emission in all directions. Therefore, if a plurality of LED illumination devices 90 is mounted on illumination equipment having a plurality of fluorescent lamps configured in series, non-illumination dark portions can be formed between neighboring LED illumination devices 90. Sometimes, the visual effect is poor. Or, when it is intended to illuminate a part of the wall surface, other parts than the part intended to be illuminated can also be illuminated if the LED illumination device 90 is used. As a result, for example, a light shield for covering half of the LED illumination device 90 needs to be disposed.

Patent Document 1: Japanese Laid-open Patent Publication No. H6-54103

SUMMARY OF THE INVENTION

The present invention has been proposed under the circumstances described above. The present invention provides an LED illumination unit, an LED illumination device, and an LED illumination system with better visual effect.

A first embodiment of the present invention provides an LED illumination unit, including: a substrate, having a carrying surface with a first direction as a length direction and a second direction perpendicular to the first direction as a width direction, and facing a third direction perpendicular to the first and second directions; a plurality of LED chips, supported by the carrying surface of the substrate; a casing, allowing the light emitted from the LED chips to penetrate and covering the LED chips; and a heat dissipation component, having a pair of outside surfaces being planar, and mounted with the substrate and the casing, wherein the pair of outside surfaces is configured opposite and parallel to each other in the second direction at an interval, and is longer than the substrate in the first direction.

In a preferred embodiment, the heat dissipation component includes a pair of side plates respectively having the outside surface and a top plate connecting end portions of the side plates in the third direction, and the substrate is mounted on an outer side of the top plate of the heat dissipation component.

In a preferred embodiment, the top plate of the heat dissipation component has a recessed portion formed thereon for accommodating the substrate.

In a preferred embodiment, the top plate has a beam portion formed thereon, and the beam portion protrudes in the third direction toward one side opposite to the side mounted with the substrate, and extends in the first direction.

In a preferred embodiment, the beam portion is located on a center of the top plate in the second direction.

In a preferred embodiment, the LED illumination unit includes a power supply portion, which supplies an electric power for turning the LED chips on, and is accommodated in a space surrounded by the pair of side plates and the top plate, and is mounted on the beam portion.

In a preferred embodiment, the beam portion has a screw hole formed thereon for fixing the power supply portion.

In a preferred embodiment, the beam portion has a hole-machining groove formed thereon, which extends in the first direction and uses the third direction as a depth direction, and the screw hole overlaps the hole-machining groove.

In a preferred embodiment, the hole-machining groove is located on a center of the beam portion in the second direction.

In a preferred embodiment, the LED illumination unit includes an electric wire connected to the power supply portion, and at least one portion of which is inserted into a space surrounded by the power supply portion, the top plate, the beam portion, and the pair of side plates.

In a preferred embodiment, the electric wire is a ground wire and conducts with the heat dissipation component.

In a preferred embodiment, each of the outside surfaces has an outer groove formed thereon and extending in the first direction.

In a preferred embodiment, the LED illumination unit includes an inner groove extending in the first direction and formed on an inside portion of each of the side plates in the second direction.

In a preferred embodiment, the casing has a pair of light output laterals which is located in the same plane as the pair of outside surfaces of the heat dissipation component.

In a preferred embodiment, the casing has a light output top surface connected to end portions of the pair of light output laterals in the third direction.

In a preferred embodiment, the light output top surface is a plane extended in the first and second directions.

In a preferred embodiment, the casing has a light output top surface facing the third direction, and a lens portion protruding from the light output top surface toward the third direction and extending in the first direction.

In a preferred embodiment, the lens portion is located on a center of the casing in the second direction.

In a preferred embodiment, the casing includes a material that allows the light emitted from the LED chips to diffuse and penetrate.

In a preferred embodiment, the casing includes a transparent material.

In a preferred embodiment, the LED illumination unit includes lid portions mounted on end portions of the heat dissipation component, and each lid portion includes a clamping piece having a clamping bump protruded toward the third direction, and a clamping hole for engagement with the clamping bump is formed on the beam portion.

In a preferred embodiment, the lid portion includes a pair of embedding pieces configured in the second direction at an interval and protruded toward the first direction, and the pair of embedding pieces is embedded to inner sides of the pair of side plates of the heat dissipation component.

A second embodiment of the present invention provides an LED illumination device, including a plurality of LED illumination units provided by the first embodiment of the present invention arranged in the first direction.

A third embodiment of the present invention provides an LED illumination system, including: at least one LED illumination unit provided by the first embodiment of the present invention; a top surface, facing the third direction; and a disposition groove, recessed from the top surface toward the third direction and extended in the first direction; wherein the LED illumination unit is accommodated in the disposition groove.

A fourth embodiment of the present invention provides an LED illumination system, including: at least one LED illumination unit provided by the first embodiment of the present invention; a top surface, facing the third direction; a disposition groove, recessed from an edge of the top surface in the second direction toward the third direction, and extended in the first direction along the edge of the top surface in the second direction; and a wall surface, connected to the disposition groove, and facing the second direction; wherein the LED illumination unit is accommodated in the disposition groove.

In a preferred embodiment, the LED illumination system includes an eave portion extended in the first direction and covered a portion of the disposition groove opposite to the wall surface.

In a preferred embodiment, the casing includes a material that allows the light emitted from the LED chips to diffuse and penetrate.

In a preferred embodiment, the casing includes a transparent material.

According to the above structure, the LED module is an elongated shape sandwiched between the pair of side surfaces and extending in the first direction lengthwise. As such, when the LED module is lighted, most of the light emitting part extends linearly, so that a good visual effect is achieved.

Other features and advantages of the present invention will become more understood from the following detailed description with reference to the accompanying drawings.

BRIEF DESCRIPTION OF THE DRAWINGS

The invention will be described according to the appended drawings in which.

DETAILED DESCRIPTION OF THE INVENTION

Preferred embodiments of the present invention are described in detail below with reference to the accompanying drawings.

Figure 1:
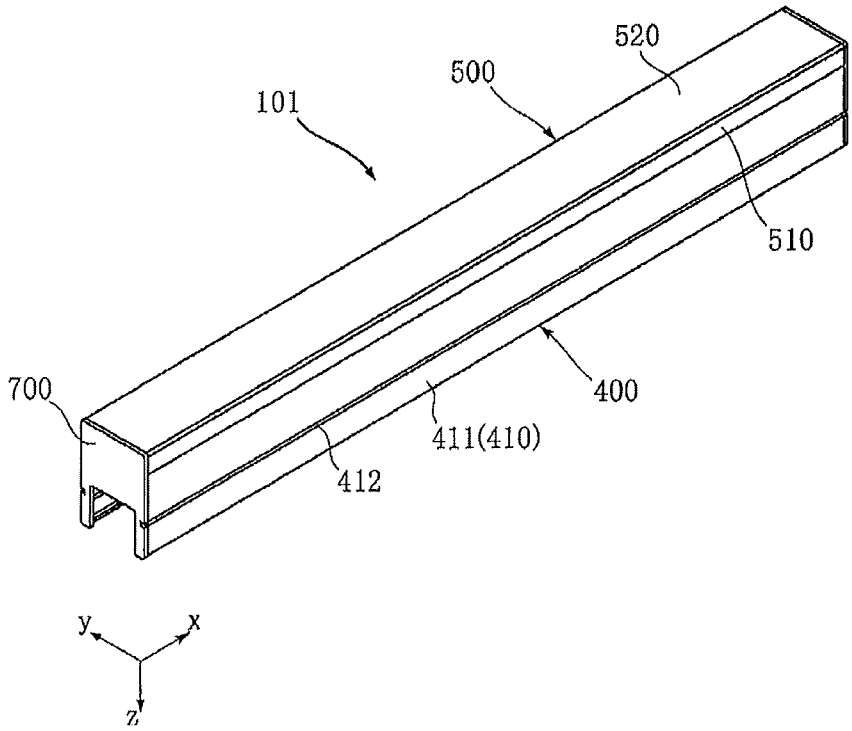
FIG. 1 is a three-dimensional view of an LED illumination unit according to a first embodiment of the present invention.
Figure 2:
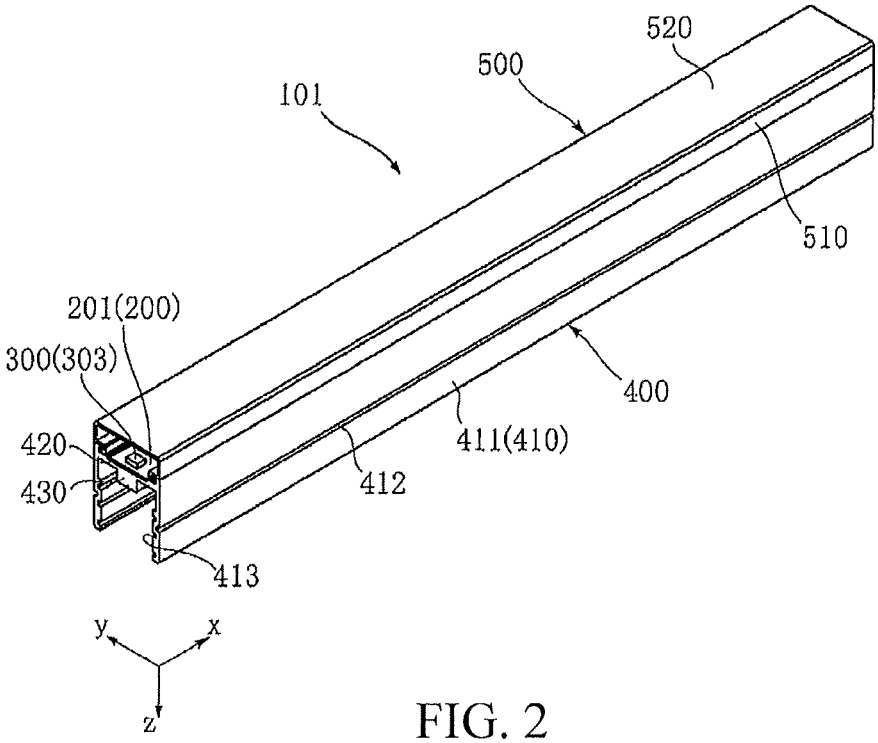
FIG. 2 is a three-dimensional view of a main part of the LED illumination unit of FIG. 1.
Figure 3:
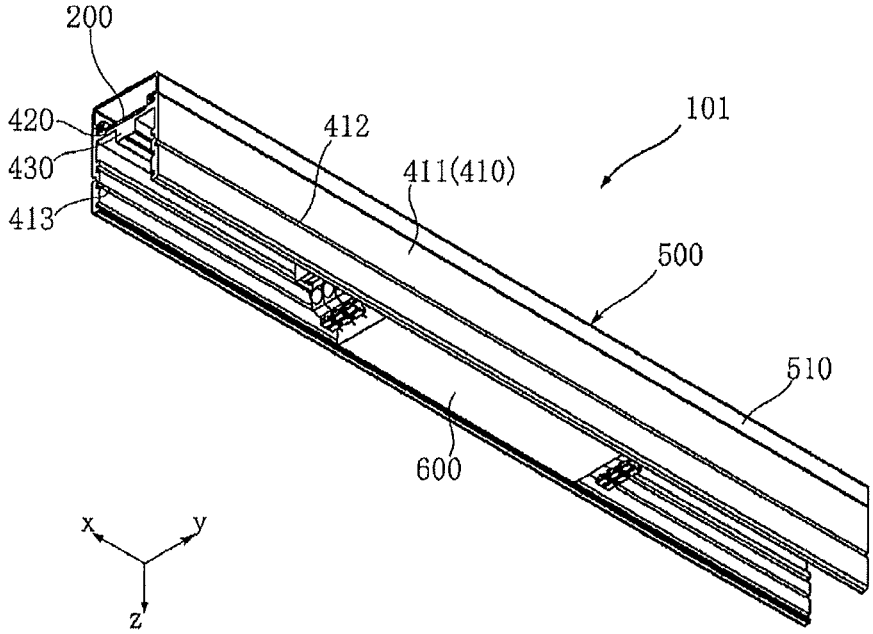
FIG. 3 is a three-dimensional view of a main part of the LED illumination unit of FIG. 1.
Figure 4:
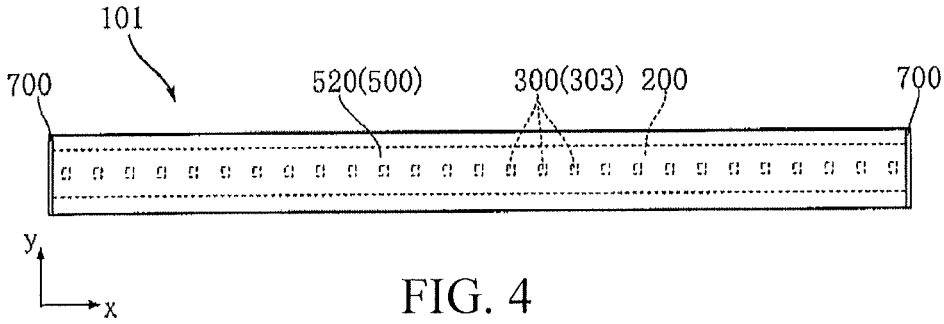
FIG. 4 is a plane view of the LED illumination unit of FIG. 1.
Figure 5:
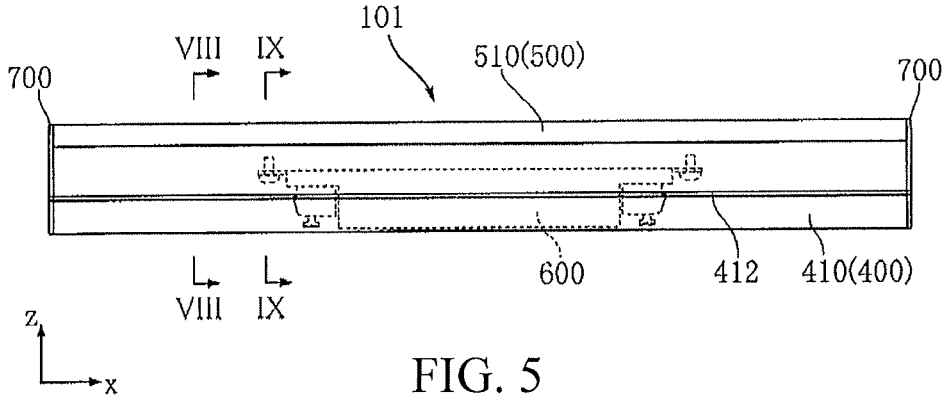
FIG. 5 is a side view of the LED illumination unit of FIG. 1.
Figure 6:
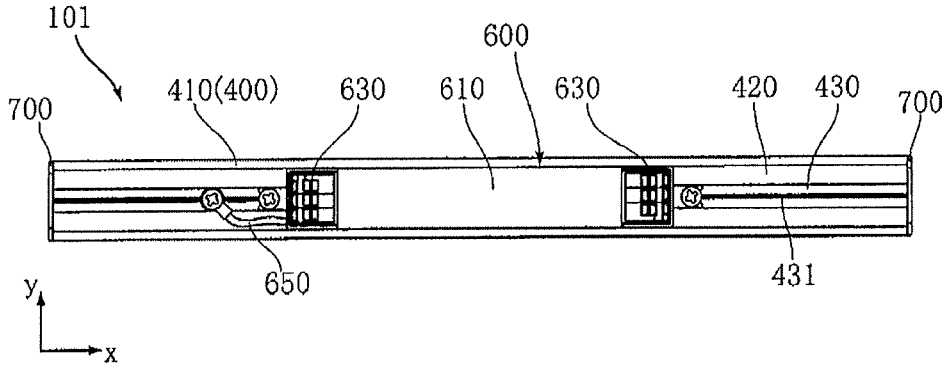
FIG. 6 is a bottom view of the LED illumination unit of FIG. 1.
Figure 7:
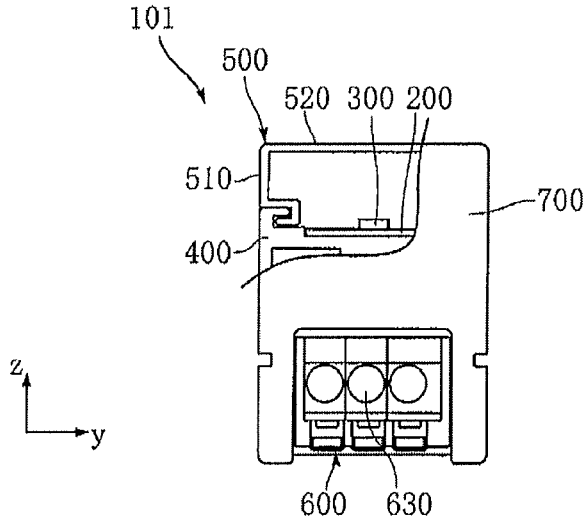
FIG. 7 is a front view of a main part of the LED illumination unit of FIG. 1.
Figure 8:
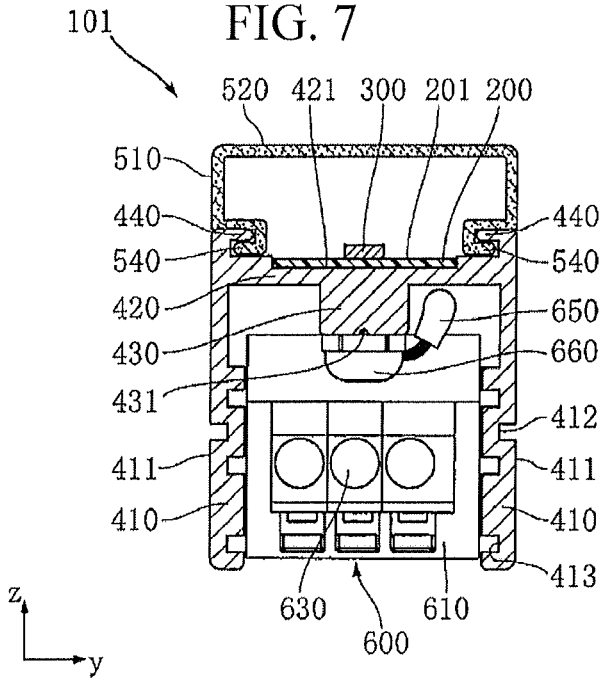
FIG. 8 is a sectional view taken along Line VIII-VIII of FIG. 5.
Figure 9:
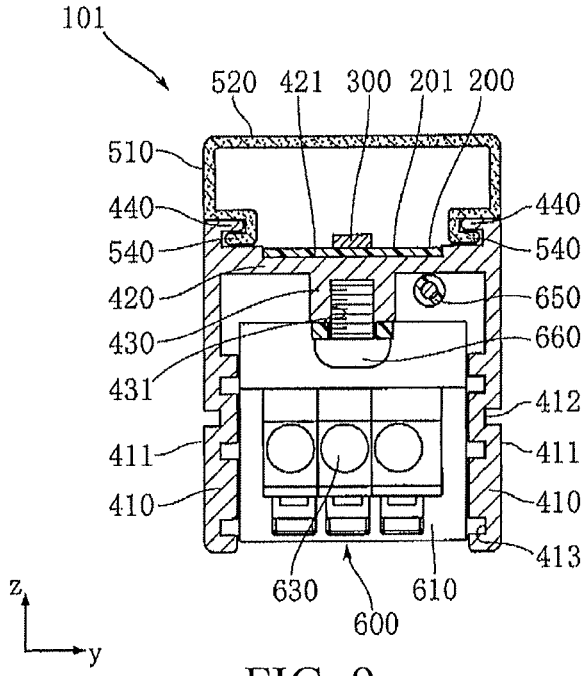
FIG. 9 is a sectional view taken along Line IX-IX of FIG. 5.

FIGS. 1-9 show an LED illumination unit according to a first embodiment of the present invention. The LED illumination unit 101 of this embodiment includes a substrate 200, a plurality of LED modules 300, a heat dissipation component 400, a casing 500, a power supply portion 600, and a lid portion 700. In addition, in FIG. 2 and FIG. 3, the lid portion 700 is omitted for ease of understanding. The whole LED illumination unit 101 extends in an x direction lengthwise, and is a rectangle when viewed toward the x direction as shown in FIG. 7.

The substrate 200 includes, for example, glass epoxy, and is a rectangle with the x direction as a length direction and a y direction as a width direction. The substrate 200 has a carrying surface 201 facing a z direction. The carrying surface 201 carries the LED modules 300.

The LED modules 300 are carried on the carrying surface 201 of the substrate 200 in a state of being arranged in the x direction. In this embodiment, the LED modules 300 are at a fixed spacing. A distance from the outermost LED module 300 in the x direction to an edge of the substrate 200 in the x direction is equal to or smaller than half of the spacing.

Figure 10:
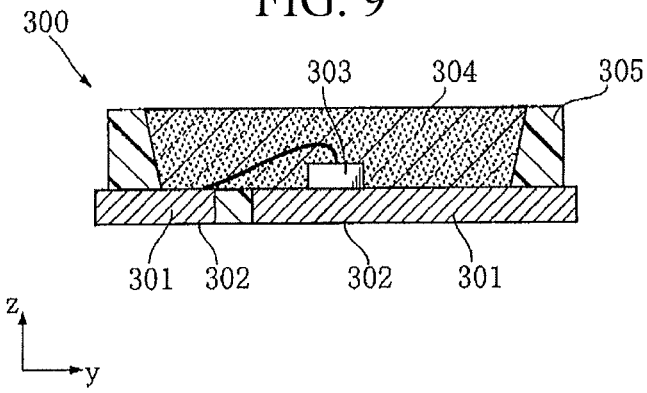
FIG. 10 is a sectional view of an LED module used in the LED illumination unit of FIG. 1.

FIG. 10 is a sectional view of an yz plane of the LED module 300. As shown in FIG. 10, the LED module 300 includes a pair of lead wires 301, an LED chip 303, a sealing resin 304, and a reflector 305. The pair of lead wires 301 includes, for example, Cu alloy, and one of the pair of lead wires carries the LED chip 303. A surface of the lead wire 301 opposite to the surface carrying the LED chip 303 becomes a mounting terminal 302 for surface mounting the LED module 300. The LED chip 303 is a light source of the LED module 300, and for example, can emit blue light. The sealing resin 304 is used for protecting the LED chip 303. The sealing resin 304 is formed by a transparent resin containing a fluorescent substance emitting yellow light after being excited by light from the LED chip 303. As such, the LED module 300 can emit white light. The fluorescent substance can also be a mixture of a fluorescent substance emitting red light with a fluorescent substance emitting green light, instead of the fluorescent substance emitting yellow light. The reflector 305 includes, for example, a white resin, for reflecting upward light laterally emitted from the LED chip 303.

As shown in FIG. 1 to FIG. 9, the heat dissipation component 400 extends in the x direction lengthwise, and includes a pair of side plates 410, a top plate 420, a beam portion 430, and a pair of clamping portions 440. The heat dissipation component 400 includes, for example, aluminum, and for example, is formed by extrusion molding. The pair of side plates 410 is respectively a rectangular plate extending in the x direction lengthwise, and is configured in the y direction in parallel and at an interval. Each side plate 410 has an outside surface 411 facing an outer side of the y direction. The length of each side plate 410 and the length of each outside surface 411 span approximately the total length of the LED illumination unit 101 in the x direction, and are equal to or greater than the length of the substrate 200. Each outside surface 411 has an outer groove 412 formed thereon. The outer groove 412 extends in the x direction, and takes the y direction as a depth direction. The outer groove 412 is, for example, disposed for clamping mounting accessories (not shown in the drawings) for disposing the LED illumination unit 101. A plurality of inner grooves 413 is formed on an inside portion of each side plate 410. The inner groove 413 extends in the x direction lengthwise, and takes the y direction as a depth direction. The inner grooves 413 are, for example, disposed for clamping mounting accessories (not shown in the drawings) for disposing the LED illumination unit 101, or disposed for fixing a decorative thin plate (not shown in the drawings) for concealing the inside of the LED illumination unit 101.

The top plate 420 connects end portions of the pair of side plates 410 in the z direction, and is a rectangle extending in the x direction lengthwise. The top plate 420 has a recessed portion 421 formed thereon. The recessed portion 421 extends in the x direction lengthwise, and is disposed at a center of the top plate 420 in the y direction. The recessed portion 421 accommodates the substrate 200. The beam portion 430 is disposed at one side of the top plate 420 opposite to the side disposed with the recessed portion 421. The beam portion 430 is a part extending in the x direction lengthwise and having a rectangular section, and is located on the center of the top plate 420 in the y direction. A hole-machining groove 431 is formed on a center of the beam portion 430 in the y direction. The hole-machining groove 431 is a small groove having a V-shaped section. The hole-machining groove 431 is disposed to facilitate the formation of holes in the beam portion 430.

A pair of clamping portions 440 is disposed at positions exceeding the substrate 200 from two ends of the top plate 420 in the y direction toward the z direction. Each clamping portion 440 extends toward an inner side of the y direction, and extends in the x direction lengthwise.

The casing 500 includes a material that enables the light emitted from the LED chips 303 (the LED modules 300) to penetrate, and covers the LED modules 300. In this embodiment, the casing 500 includes a material that allows the light emitted from the LED chips 303 (the LED modules 300) to diffuse and penetrate. The casing 500 has a pair of light output laterals 510, a light output top surface 520 and a pair of clamping portions 540. The casing 500 extends in the x direction lengthwise and has a U-shaped section. The pair of light output laterals 510 extends in the x direction lengthwise, and is configured in the y direction in parallel and at an interval. The pair of light output laterals 510 is located in the same plane as the pair of outside surfaces 411 of the heat dissipation component 400. The light output top surface 520 connects end portions of the pair of light output laterals 510 in the z direction. In this embodiment, the light output top surface 520 is a plane facing the z direction. The pair of clamping portions 540 is farther way from the substrate 200 than the end portions of the pair of light output laterals in the z direction, and respectively has a front end portion extending toward an outer side of the y direction. Through engagement of the clamping portions 540 and the clamping portion 440 of the heat dissipation component 400, the casing 500 is mounted on the heat dissipation component 400.

Figure 11:
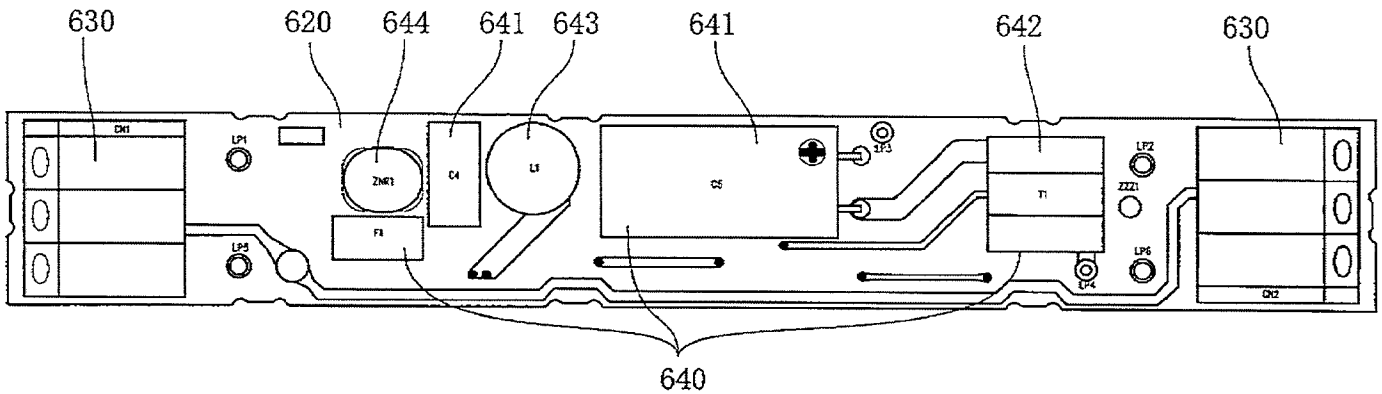
FIG. 11 is a plane view of a power supply substrate and electronic parts used in the LED illumination unit of FIG. 1.
Figure 12:
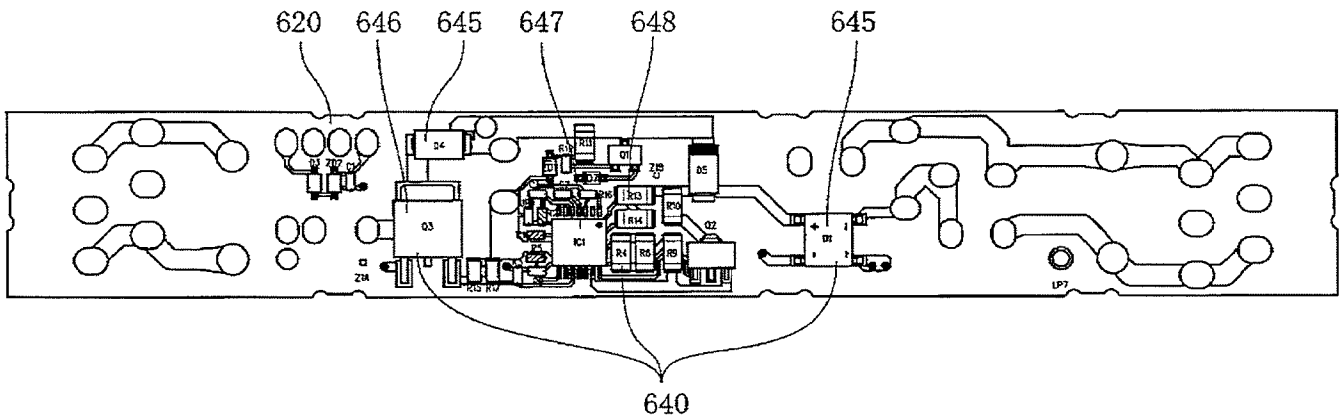
FIG. 12 is a bottom view of a power supply substrate and electronic parts used in the LED illumination unit of FIG. 1.

The power supply portion 600 is used for supplying an electric power to the LED modules 300, and is accommodated in a space surrounded by the pair of side plates 410 and the top plate 420. The power supply portion 600 includes a housing 610, a power supply substrate 620, a terminal 630, and a plurality of electronic parts 640. The housing 610 is, for example, made of a white resin, and has an overall rectangular shape. As shown in FIG. 11 and FIG. 12, the power supply substrate 620 is a rectangle, and is mounted with the terminal 630 and the electronic parts 640. The terminal 630 is connected with an electric wire (not shown in the drawings) for delivering an electrical current to the power supply portion 600. The electronic parts 640 are, for example, used for implementing a function of converting an alternating current to a direct current suitable for the LED modules 300 (the LED chips 303). As shown in FIG. 11, the electronic parts 640 include a capacitor 641, a transformer 642, a coil 643 and a rheostat element 644 mounted on one surface of the power supply substrate 620. Moreover, as shown in FIG. 12, the electronic parts 640 include a transistor 646, an IC (integrated circuit) 647 and a resistor 648 mounted on another surface of the power supply substrate 620. The IC 647 is used for converting an alternating current input for performing phase control through an external controller to a direct current output corresponding to the alternating current, and is responsible for regulating electric power supplied to the LED chips 303.

The power supply portion 600 is mounted on the beam portion 430 through a screw 660. The beam portion 430 has a screw hole 432 formed thereon for thread engagement with the screw 660. When the beam portion 430 is processed to form the screw hole 432, a front end of a drill is pressed against the hole-machining groove. A ground wire 650 extends from the power supply portion 600. One end of the ground wire 650 is connected to the inside or the terminal 630 of the power supply portion 600, and the other end of the ground wire 650 is connected to the heat dissipation component 400. A part of the ground wire 650 is accommodated in a space surrounded by the beam portion 430, the top plate 420, the pair of side plates 410, and the power supply portion 600.

Figure 13:
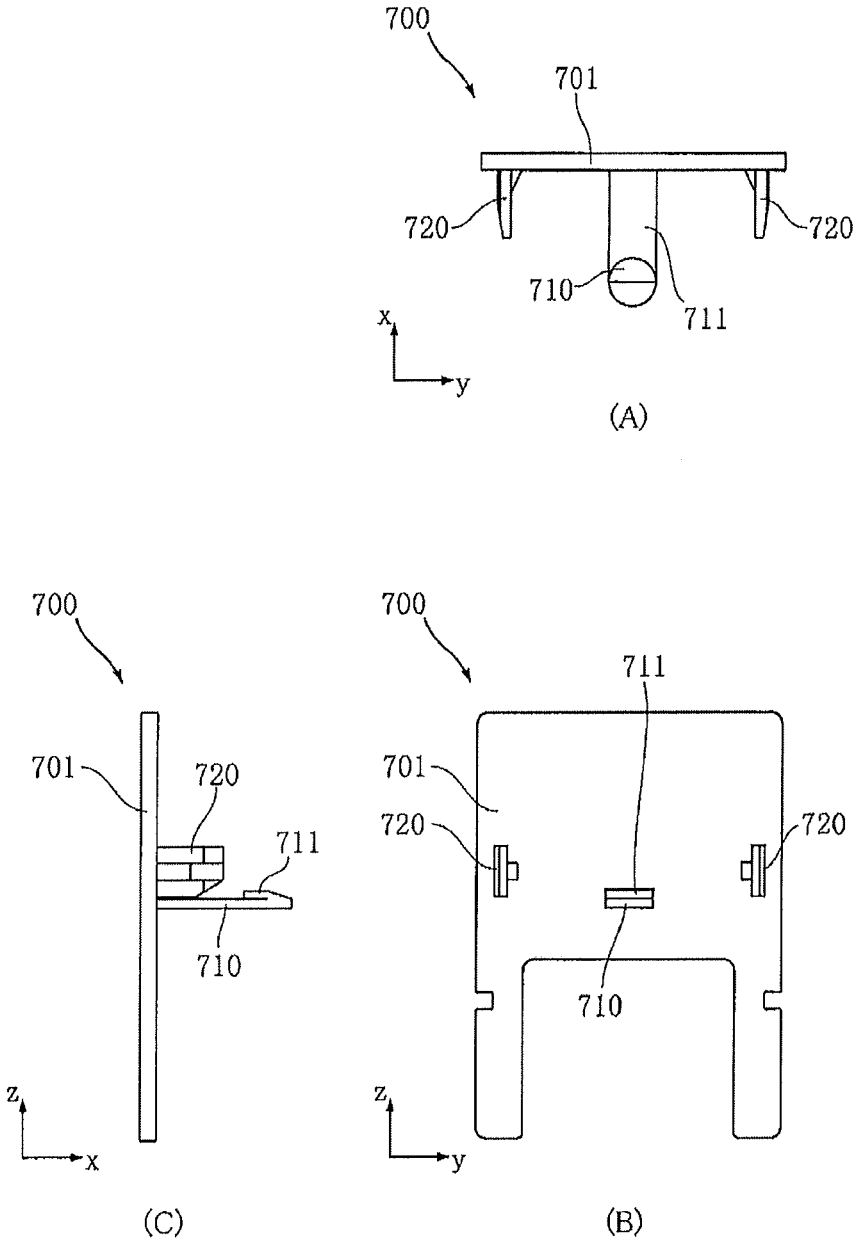
FIG. 13(A), FIG. 13(B) and FIG. 13(C) are respectively a plane view, a front view and a side view of a lid portion used in the LED illumination unit of FIG. 1.
Figure 14:
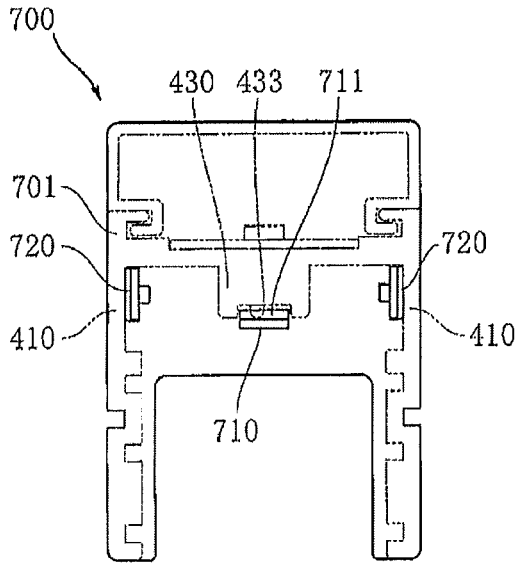
FIG. 14 is a front view of a lid portion used in the LED illumination unit of FIG. 1.

The lid portions 700 are mounted on two ends of the heat dissipation component 400 in the x direction, and are used for concealing the inside of the LED illumination unit 101. FIG. 13 shows an example of a specific structure of the lid portion 700. The lid portion 700 shown in FIG. 13 has a main plate 701, a clamping piece 710 and a pair of embedding pieces 720, and includes, for example, resin. The main plate 701 has a shape matching the shape of the heat dissipation component 400 and the casing 500 when viewed toward the x direction, and is formed with a notch facing the terminal 630 of the power supply portion 600. The clamping piece 710 extends from approximately a center of the main plate 701 toward the x direction, and a clamping bump 711 is formed on a front end side portion of the clamping piece. The clamping bump 711 slightly protrudes out toward the x direction. The pair of embedding pieces 720 is configured in the y direction at an interval, and extends in the x direction in parallel. As shown in FIG. 14, a clamping hole 440 is formed on the beam portion 430 of the heat dissipation component 400. The clamping hole 440 is formed by using the hole-machining groove 431. When the lid portion 700 is mounted, the pair of embedding pieces 720 is embedded into inner sides of the pair of side plates 410, and meanwhile, the clamping bump 711 of the clamping piece 710 is clamped in the clamping hole 433.

Figure 15:
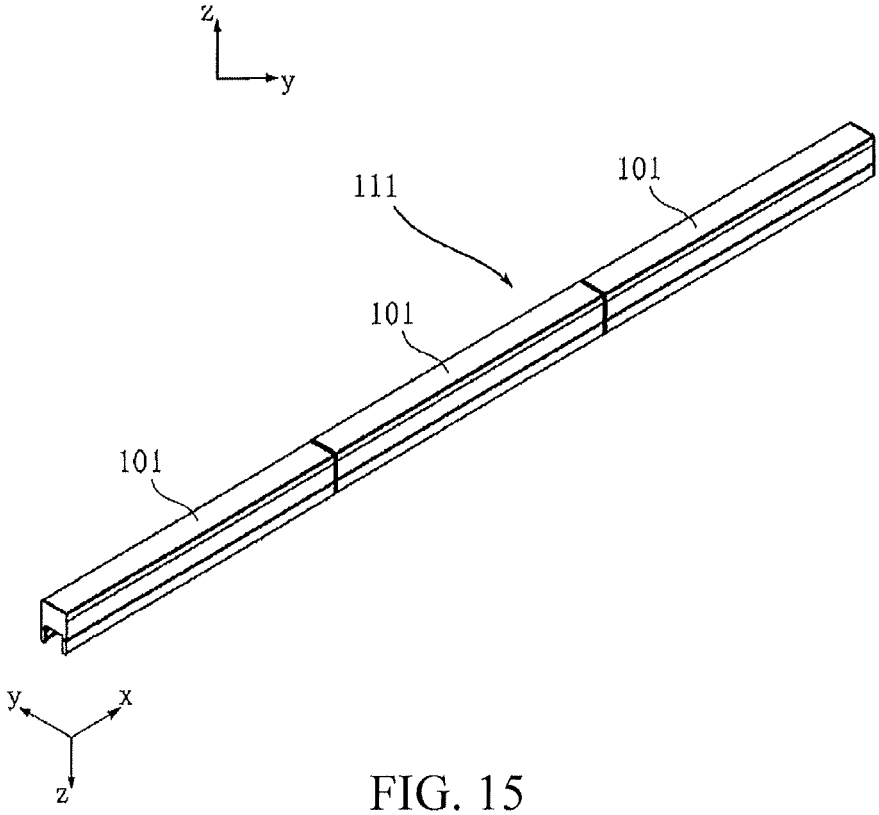
FIG. 15 is a three-dimensional view of an LED illumination device according to the first embodiment of the present invention.

FIG. 15 shows an example of an LED illumination device including a plurality of LED illumination units 101. The LED illumination device 111 of this embodiment includes three LED illumination units 101 configured in series in the x direction. The power supply portions 600 of the three LED illumination units 101 are connected through three electric wires (not shown in the drawings), for example, two for alternating current and one for grounding. The electric wires are connected to the terminals 630 of the power supply portions 600, and are accommodated inside the heat dissipation component 400.

Figure 16:
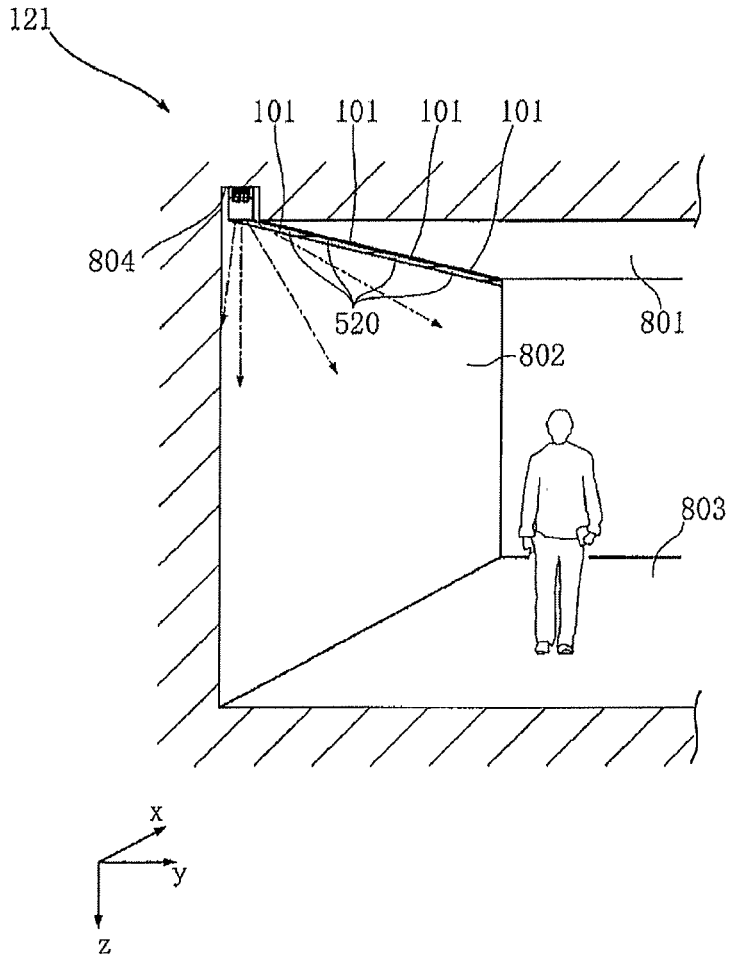
FIG. 16 is a three-dimensional view of an LED illumination system according to the first embodiment of the present invention.
Figure 17:
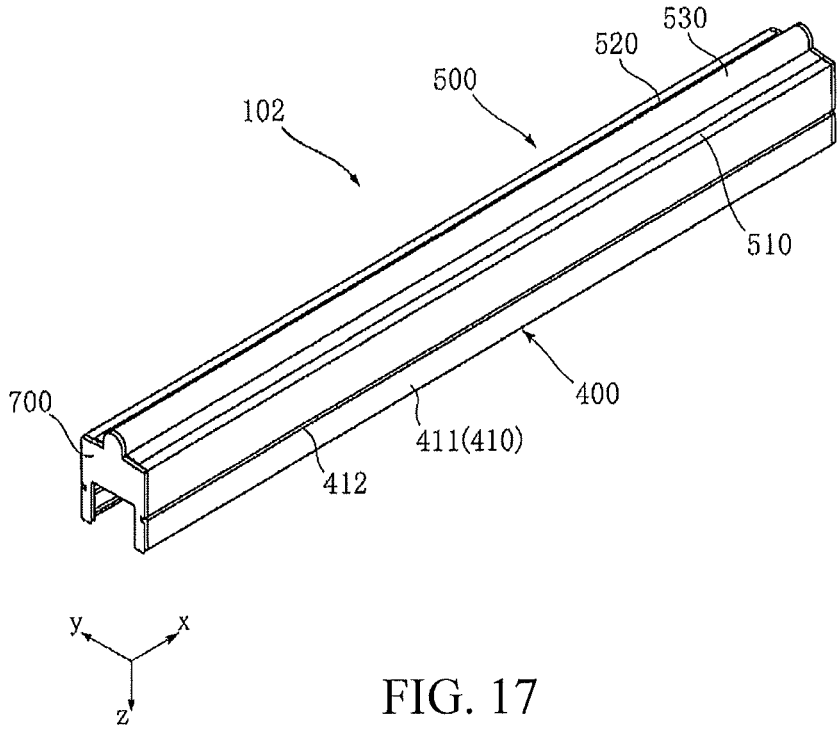
FIG. 17 is a three-dimensional view of an LED illumination unit according to a second embodiment of the present invention.
Figure 18:
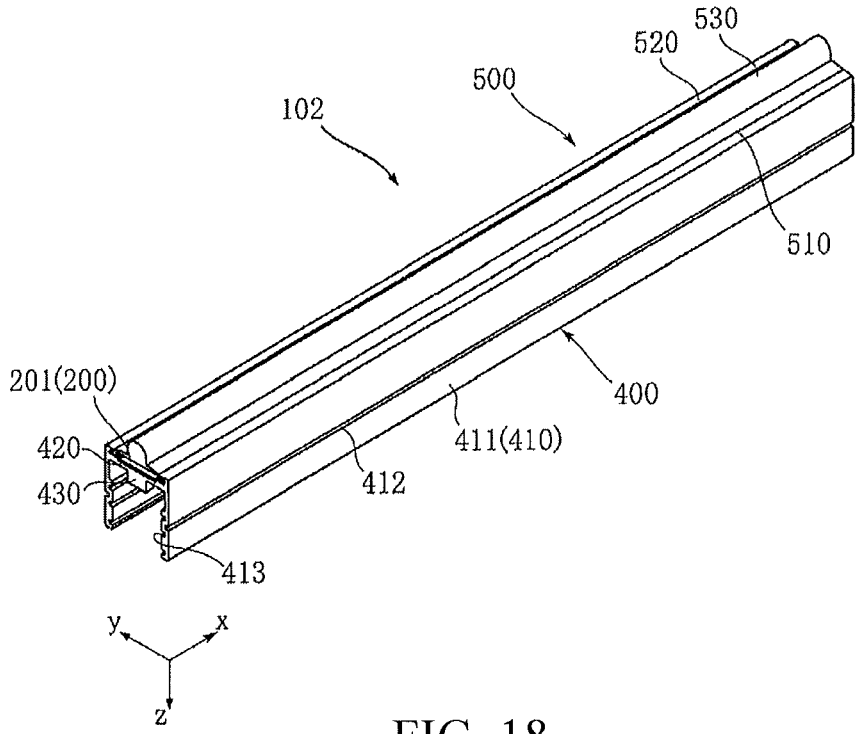
FIG. 18 is a three-dimensional view of a main part of the LED illumination unit of FIG. 17.
Figure 19:
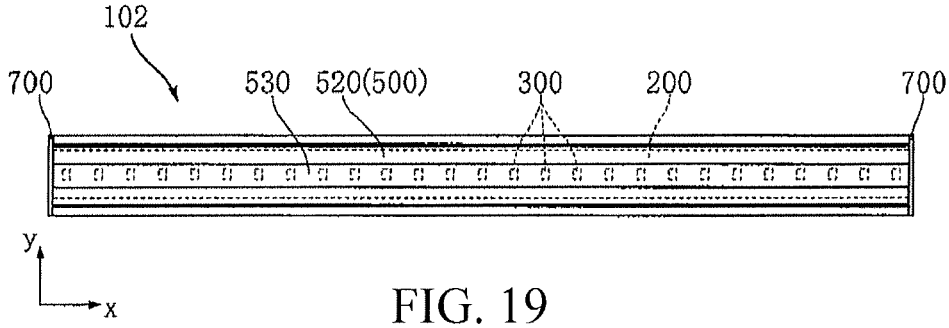
FIG. 19 is a plane view of the LED illumination unit of FIG. 17.
Figure 20:
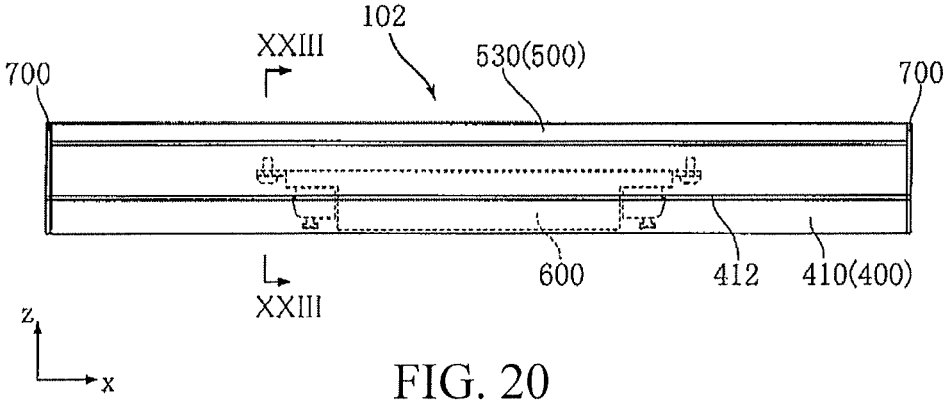
FIG. 20 is a side view of the LED illumination unit of FIG. 17.
Figure 21:
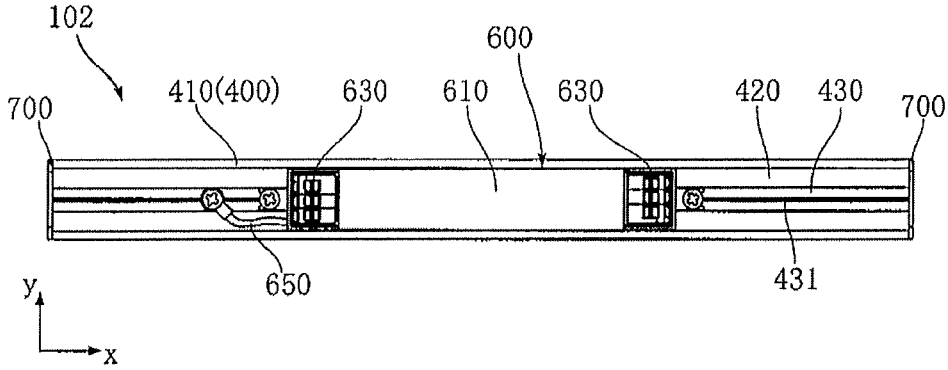
FIG. 21 is a bottom view of the LED illumination unit of FIG. 17.
Figure 22:
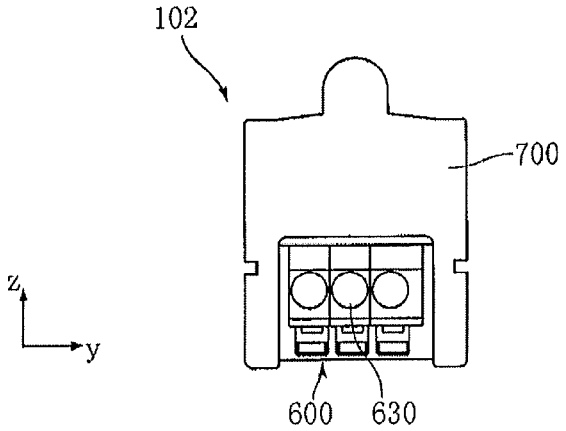
FIG. 22 is a front view of the LED illumination unit of FIG. 17.
Figure 23:
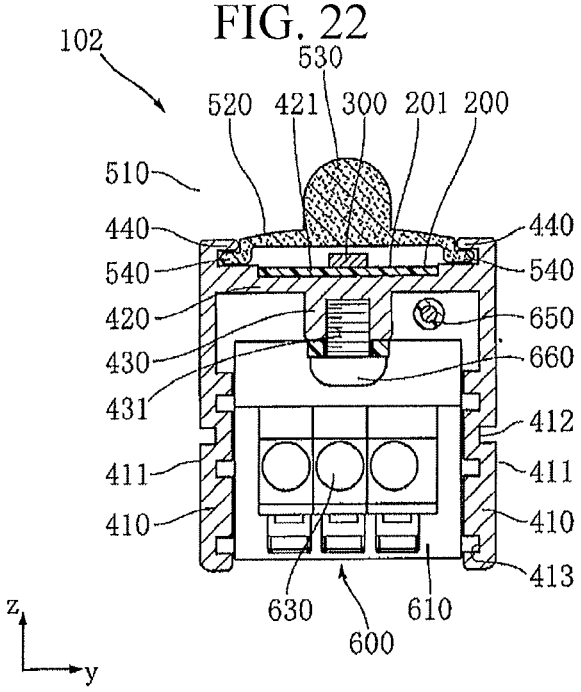
FIG. 23 is a sectional view taken along Line XXIII-XXIII of FIG. 20.

FIG. 16 shows an example of an LED illumination system including a plurality of LED illumination units 101. The LED illumination system 121 of this embodiment includes a plurality of LED illumination units 101, and in addition, the LED illumination system further includes a top surface 801, a wall surface 802, and a disposition groove 804. The disposition groove 804 is a groove located between an edge of the top surface 801 in the y direction and the wall surface 802, extending in the x direction lengthwise, and having a rectangular section.

The LED illumination units 101 are configured in series in the x direction with the light output top surface 520 being toward the z direction (facing the ground 803). Preferably, the light output top surface 520 is the top surface 801.

Secondly, functions of the LED illumination unit 101, the LED illumination device 111 and the LED illumination system 121 are described.

According to this embodiment, the LED module 101 is an elongated shape sandwiched between the pair of side surfaces 411 and extending in the x direction lengthwise. Therefore, when the LED illumination device 111 or the LED illumination system 121 is constructed, the part occupied by the LED module 101 extends in the x direction in an elongated manner. As such, when the LED module 101, the LED illumination device 111 and the LED illumination system 121 are lighted, most of the light emitting part extends linearly, so that a good visual effect is achieved.

As the LED module 101 is rectangular when viewed toward the x direction, the LED module 101 is suitable for being disposed in the disposition groove 804. The U-shaped heat dissipation component 400 is suitable for designing the appearance of the LED illumination unit 101 to be rectangular, and can increase the area for heat dissipation. Through the recessed portion 421, the substrate 200 can surely be mounted on a desired position.

By accommodating the power supply portion 600 inside the heat dissipation component 400, the formation of an undesirably uneven appearance of the LED illumination unit 101 is avoided. The formation of the space surrounded by the beam portion 430, the top plate 420, the pair of side plates 410 and the power supply portion 600 facilitates configuration of the ground wire 650 to prevent interference with other elements. The hole-machining groove 431 is suitable for the following case: forming, for example, the screw hole 432 or the clamping hole 433, at a desired position of the beam portion 430 in the x direction.

By using the outer groove 412, the LED illumination unit 101 can be easily and surely mounted. By using the inner grooves 413, the LED illumination unit 101 can be easily and surely mounted, and the decorative thin plate for concealing the inside of the LED illumination unit 101 can also be disposed at a desired position.

By disposing the light output laterals 510 on the casing 500 which are the outside surfaces 411, and designing the light output top surface 520 into a plane, the appearance of the LED illumination unit 101 can have a portable shape.

By disposing the clamping piece 710 and the pair of embedding pieces 720 on the lid portion 700, the lid portion 700 can be surely mounted on the heat dissipation component 400 in a so-called "one push" manner.

As shown in FIG. 16, in the LED illumination system 121, as the light output top surface 520 is planar and the casing 500 diffuses light, light from the LED illumination units 101 illuminates in a wide range toward the wall surface 802 and the ground 803, which is suitable for illuminating the room disposed with the LED illumination system 121 more evenly and in a wide range.

FIGS. 17-27 show other embodiments of the present invention. In addition, in FIG. 17 to FIG. 27, same reference numerals are used to denote elements that are the same as or similar to those described in the above embodiments.

FIGS. 17-23 show an LED illumination unit according to a second embodiment of the present invention. The casing 500 of the LED illumination unit 102 of this embodiment has a different structure from that described in the above embodiments.

In this embodiment, the casing 500 has a lens portion 530, but is not disposed with the light output laterals. The lens portion 530 projects from the light output top surface 520 toward the z direction, and extend in the x direction lengthwise. The lens portion 530 is located on a center of the casing 500 in the y direction, and overlaps the LED modules 300 in the y direction. A surface of the casing 500 opposite to the LED modules 300 becomes a plane disposed at a position relatively close to the LED modules 300. Similar to the above embodiments, the casing 500 includes a material that allows the light emitted from the LED modules 300 to diffuse and penetrate. The lid portion 700 becomes a shape having a protruding portion overlapping the lens portion 530 of the casing 500.

Figure 24:
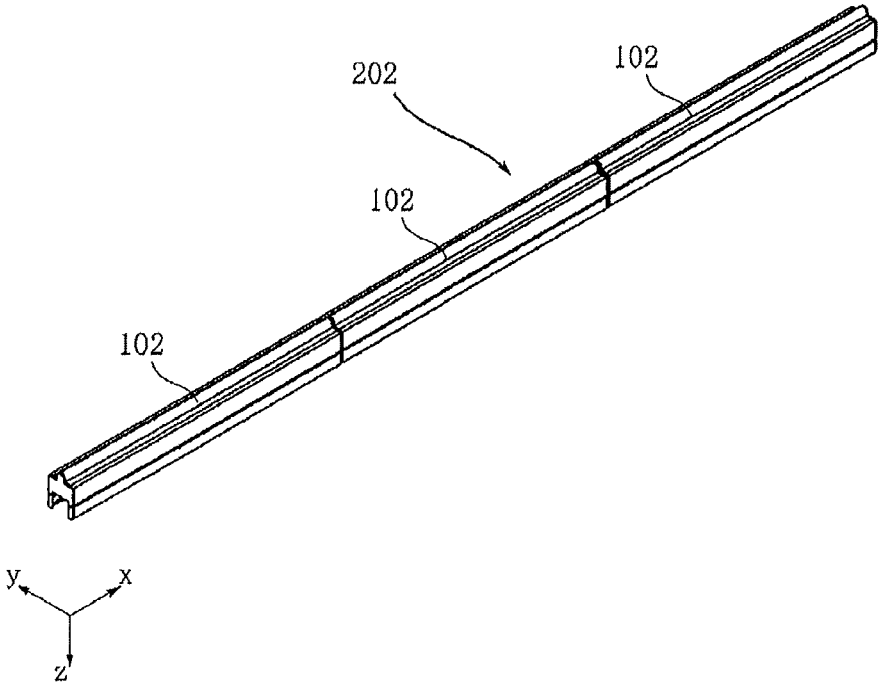
FIG. 24 is a three-dimensional view of an LED illumination device according to the second embodiment of the present invention.

FIG. 24 shows an example of an LED illumination device including a plurality of LED illumination units 102. The LED illumination device 202 of this embodiment includes three LED illumination units 102 configured in series in the x direction. The power supply portions 600 of the three LED illumination units 102 are connected through three electric wires (not shown in the drawings), for example, two for alternating current and one for grounding. Each electric wire is connected to the terminal 630 of the power supply portion 600, and is accommodated inside the heat dissipation component 400.

Figure 25:
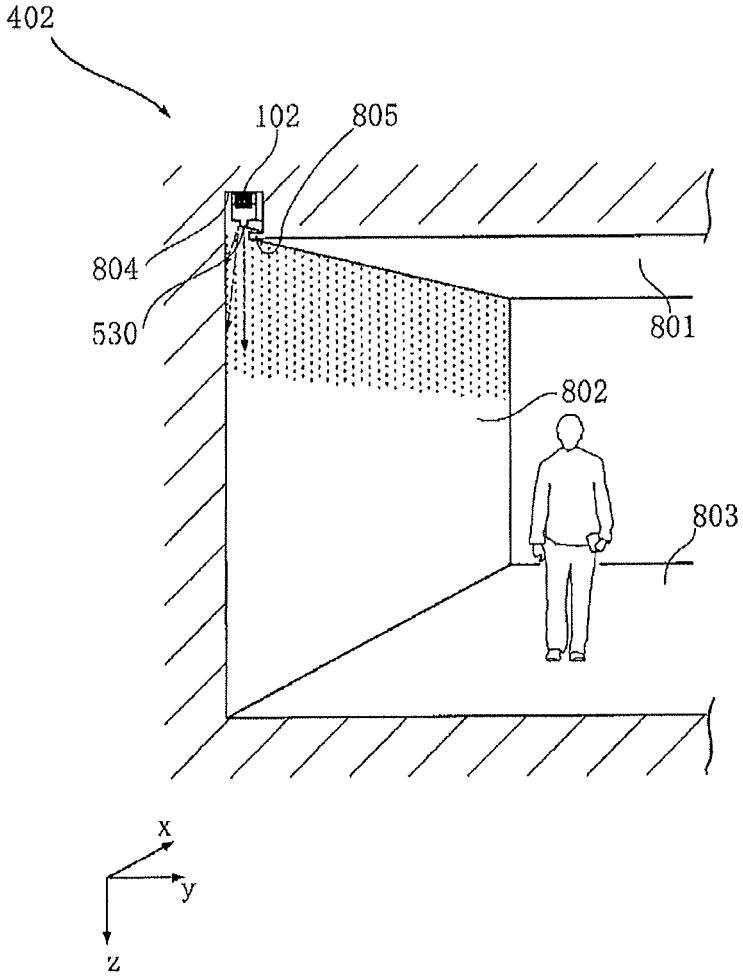
FIG. 25 is a three-dimensional view of an LED illumination system according to the second embodiment of the present invention.

FIG. 25 shows an example of an LED illumination system including a plurality of LED illumination units 102. The LED illumination system 402 of this embodiment includes a plurality of LED illumination units 102, and in addition, the LED illumination system further includes a top surface 801, a wall surface 802, a disposition groove 804 and an eave portion 805. The disposition groove 804 is a groove located between an edge of the top surface 801 in the y direction and the wall surface 802, extended in the x direction lengthwise, and having a rectangular section. The eave portion 805 extends from the edge of the top surface 801 in the y direction toward the y direction, runs through the total length of the disposition groove 804, and covers a right side portion of the disposition groove 804 in the y direction. The LED illumination units 102 are configured in series in the x direction with the lens portion 530 being toward the z direction (facing the ground 803).

According to the embodiment, when the LED module 102, the LED illumination device 202 and the LED illumination system 402 are lighted, most of the light emitting part extends linearly, so that a good visual effect is achieved.

Through the lens portion 530, the light from the LED modules 300 is condensed in the y direction. The condensation is alleviated according to the degree of light diffusion caused by the casing 500. As such, as shown in FIG. 25, the LED illumination system 402 exerts an indirect illumination function of brightly illuminating an upper side portion (shadow portion in the figure) of the wall surface 802 in the z direction. Through the eave portion 805, the light from the LED illumination units 102 is prevented from directly reaching the ground 803.

Figure 26:
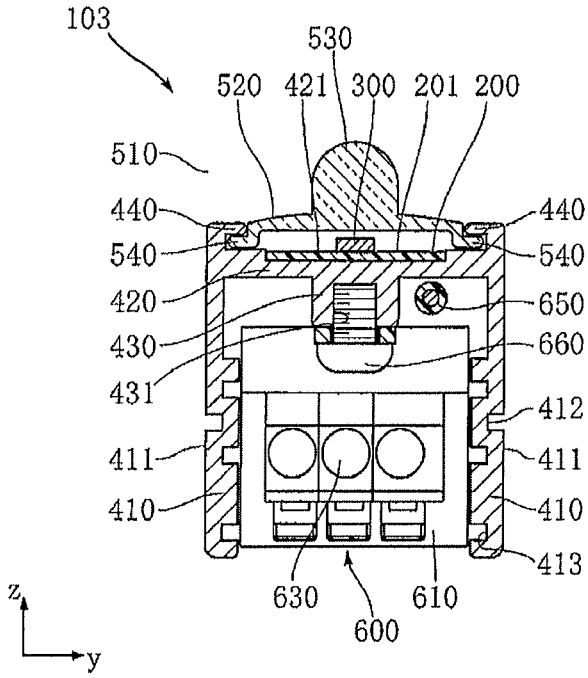
FIG. 26 is a sectional view of an LED illumination unit according to a third embodiment of the present invention.

FIG. 26 shows an LED illumination unit according to a third embodiment of the present invention. The casing 500 of the LED illumination unit 103 of this embodiment has a different structure from that described in the above embodiments. In this embodiment, the casing 500 includes a transparent material, except for which the LED illumination unit 103 is the same as the LED illumination unit 102.

Figure 27:
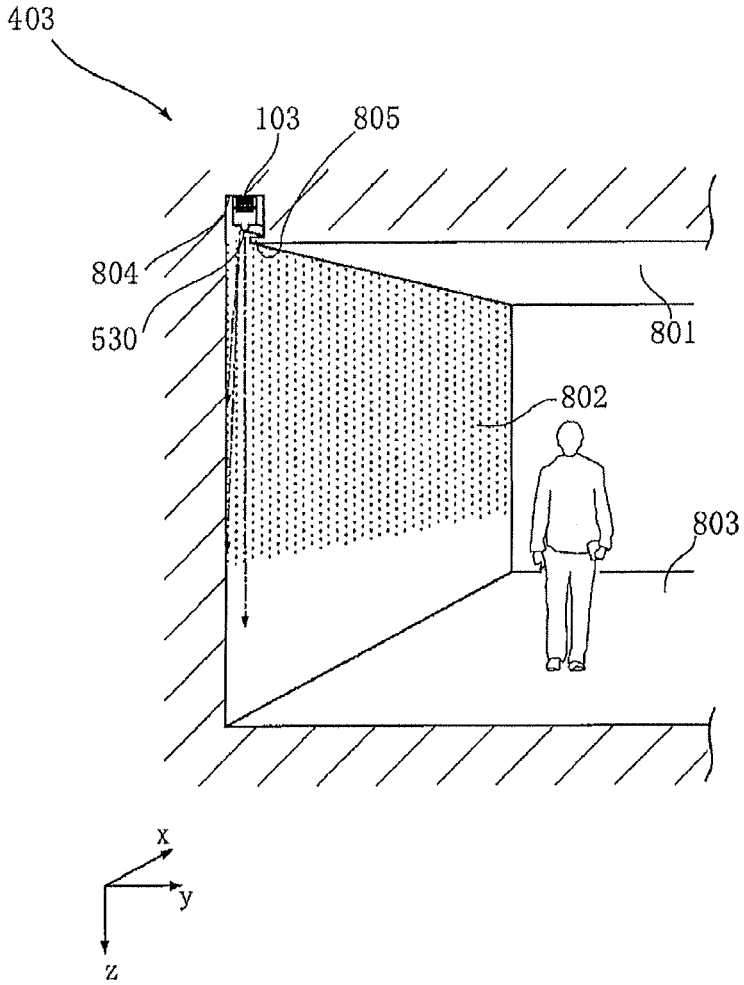
FIG. 27 is a three-dimensional view of an LED illumination system according to the third embodiment of the present invention.
Figure 28:
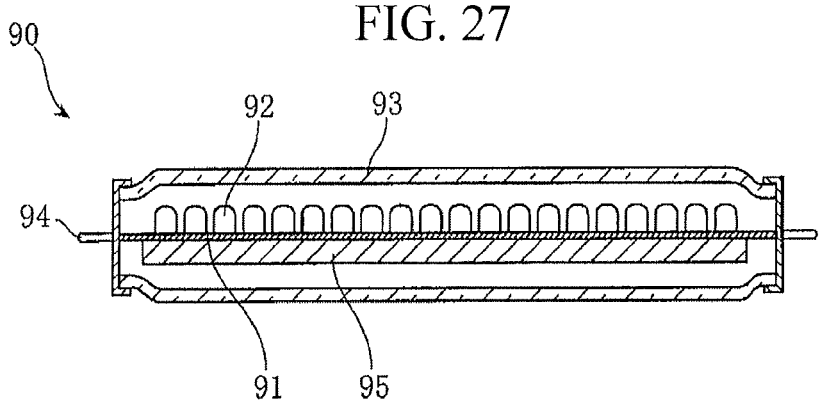
FIG. 28 is a sectional view of an example of a conventional LED illumination device.

FIG. 27 shows an example of an LED illumination system including a plurality of LED illumination units 103. The LED illumination system 403 of this embodiment includes a plurality of LED illumination units 103, and in addition, the LED illumination system further includes a top surface 801, a wall surface 802, a disposition groove 804, and an eave portion 805. The disposition groove 804 is a groove located between an edge of the top surface 801 in the y direction and the wall surface 802, extended in the x direction lengthwise, and having a rectangular section. The eave portion 805 extends from the edge of the top surface 801 in the y direction toward the y direction, runs through the total length of the disposition groove 804, and covers a right side portion of the disposition groove 804 in the y direction. The LED illumination units 102 are configured in series in the x direction with the lens portion 530 being toward the z direction (facing the ground 803).

According to the embodiment, when the LED module 103 and the LED illumination system 403 are lighted, most of the light emitting part extends linearly, so that a good visual effect is achieved.

Through the lens portion 530 formed by a transparent material, the light from the LED modules 300 can be fully condensed in the y direction. As such, as shown in FIG. 27, the LED illumination system 403 brightly illuminates a region (shadow portion in the figure) from an upper side portion to a lower side portion of the wall surface 802 in the z direction. Therefore, the LED illumination system 403 exerts an indirect illumination function of brightly illuminating the whole wall surface 802.

The LED illumination unit, the LED illumination device and the LED illumination system of the present invention are not limited to the above embodiments. Various variations can be made freely to the specific structure of each part of the LED illumination unit, the LED illumination device and the LED illumination system of the present invention.

According to the length of the substrate 200 in the x direction and the number of the LED modules 300, one LED illumination unit 101, 102, or 103 can also include a plurality of power supply portions 600.

While several embodiments of the present invention have been illustrated and described, various modifications and improvements can be made by those skilled in the art. The embodiments of the present invention are therefore described in an illustrative but not in a restrictive sense. It is intended that the present invention should not be limited to the particular forms as illustrated and that all modifications which maintain the spirit and scope of the present invention are within the scope defined in the appended claims.

What is claimed is:

1. A LED illumination unit, comprising:

a substrate, having a carrying surface with a first direction as a length direction and a second direction perpendicular to the first direction as a width direction, and facing a third direction perpendicular to the first and second directions;

a plurality of LED chips, supported by the carrying surface of the substrate;

a casing, allowing the light emitted from the LED chips to penetrate and covering the LED chips; and a heat dissipation component, having a pair of outside surfaces being planar, and mounted with the substrate and the casing, wherein the pair of outside surfaces is configured opposite and parallel to each other in the second direction at an interval, and is longer than the substrate in the first direction.

2. The LED illumination unit according to claim 1, wherein the heat dissipation component comprises a pair of side plates respectively having the outside surface and a top plate connecting to end portions of the side plates in the third direction; and the substrate is mounted on an outer side of the top plate of the heat dissipation component.

3. The LED illumination unit according to claim 2, wherein the top plate of the heat dissipation component has a recessed portion formed thereon for accommodating the substrate.

4. The LED illumination unit according to claim 2, wherein the top plate has a beam portion formed thereon, and the beam portion protrudes in the third direction toward one side opposite to the side mounted with the substrate, and extends in the first direction.

5. The LED illumination unit according to claim 4, wherein the beam portion is located on a center of the top plate in the second direction.

6. The LED illumination unit according to claim 4, further comprising a power supply portion, which supplies an electric power for turning the LED chips on, and is accommodated in a space surrounded by the pair of side plates and the top plate, and is mounted on the beam portion.

7. The LED illumination unit according to claim 6, wherein the beam portion has a screw hole formed thereon for fixing the power supply portion.

8. The LED illumination unit according to claim 7, wherein the beam portion has a hole-machining groove formed thereon, which extends in the first direction and uses the third direction as a depth direction; and the screw hole overlaps the hole-machining groove.

9. The LED illumination unit according to claim 8, wherein the hole-machining groove is located on a center of the beam portion in the second direction.

10. The LED illumination unit according to claim 6, further comprising an electric wire connected to the power supply portion, and at least one portion of which is inserted into a space surrounded by the power supply portion, the top plate, the beam portion, and the pair of side plates.

11. The LED illumination unit according to claim 10, wherein the electric wire is a ground wire and conducts with the heat dissipation component.

12. The LED illumination unit according to claim 2, further comprising an inner groove extending in the first direction and formed on an inside portion of each of the side plates in the second direction.

13. The LED illumination unit according to claim 4, further comprising lid portions mounted on end portions of the heat dissipation component, and each lid portion comprising a clamping piece having a clamping bump protruded toward the third direction; and a clamping hole for engagement with the clamping bump is formed on the beam portion.

14. The LED illumination unit according to claim 13, wherein the lid portion comprises a pair of embedding pieces configured in the second direction at an interval and protruded toward the first direction; and the pair of embedding pieces is embedded to inner sides of the pair of side plates of the heat dissipation component.

15. The LED illumination unit according to claim 1, wherein each of the outside surfaces has an outer groove formed thereon and extending in the first direction.

16. The LED illumination unit according to claim 1, wherein the casing comprises a material that allows the light emitted from the LED chips to diffuse and penetrate.

17. The LED illumination unit according to claim 1, wherein the casing has a light output top surface facing the third direction, and a lens portion protruding from the light output top surface toward the third direction and extending in the first direction.

18. The LED illumination unit according to claim 17, wherein the lens portion is located on a center of the casing in the second direction.

19. The LED illumination unit according to claim 17, wherein the casing comprises a transparent material.

20. A LED illumination system, comprising:

at least one LED illumination unit according to claim 17;

a top surface, facing the third direction;

a disposition groove, recessed from an edge of the top surface in the second direction toward the third direction, and extended in the first direction along the edge of the top surface in the second direction; and a wall surface, connected to the disposition groove, and facing the second direction;

wherein the LED illumination unit is accommodated in the disposition groove.

21. The LED illumination system according to claim 20, further comprising an eave portion extended in the first direction and covered a portion of the disposition groove opposite to the wall surface.

22. The LED illumination system according to claim 20, wherein the casing comprises a material that allows the light emitted from the LED chips to diffuse and penetrate.

23. The LED illumination system according to claim 20, wherein the casing comprises a transparent material.

24. A LED illumination system, comprising:

at least one LED illumination unit according to claim 1;

a top surface, facing the third direction; and a disposition groove, recessed from the top surface toward the third direction and extended in the first direction;

wherein the LED illumination unit is accommodated in the disposition groove.

25. A LED illumination device, comprising a plurality of LED illumination units arranged in the first direction according to claim 1.

26. The LED illumination unit according to claim 1, wherein the casing has a pair of light output laterals which are located in the same plane as the pair of outside surfaces of the heat dissipation component.

27. The LED illumination unit according to claim 26, wherein the casing has a light output top surface connected to end portions of the pair of light output laterals in the third direction.

28. The LED illumination unit according to claim 27, wherein the light output top surface is a plane extended in the first and second directions.

* * * * *